United States Patent [19]

Nottoli

[11] Patent Number: 4,700,949

[45] Date of Patent: Oct. 20, 1987

[54] GOLF PUTTING TRAINER

[76] Inventor: Robert G. Nottoli, 4321 E. Stanford Dr., Phoenix, Ariz. 85018

[21] Appl. No.: 6,797

[22] Filed: Jan. 27, 1987

[51] Int. Cl.[4] ..... A63B 69/36

[52] U.S. Cl. ..... 273/192; 273/186 C

[58] Field of Search ..... 273/191 R, 191 A, 191 B, 273/192, 186 A, 186 R, 193 B

[56] References Cited

U.S. PATENT DOCUMENTS 3,473,810 10/1969 Nishikawa ..... 273/192

FOREIGN PATENT DOCUMENTS 26125 of 1905 United Kingdom ..... 273/192

*Primary Examiner*—George J. Marlo

[57] ABSTRACT

A golf putting device including a golf putter club (34), a guide rail (10) and a trolley (11) which rolls on wheels (15, 16, 17 and 18) engaged with the rail (10). The trolley (11) includes hinge plates (26, 28, 30) connected together by hinge pins (27, 29, 31) which allow a rocking action and a lifting action by the hinge plates (26, 28, 30), which in turn allow the club (34) to move in an arc (35) to stroke the ball in a straight line to a target.

1 Claim, 4 Drawing Figures

GOLF PUTTING TRAINER

BACKGROUND OF INVENTION

I find no prior art that exists in any form as related to this invention. Frustration of millions of golfers over the inability to consistently stroke a golf ball in a straight line fostered the idea that prompted my research and development of the Golf Putting Trainer. If resulted in knowing that it is humanly possible to relate physical body activities to the mind and commit the feeling to memory. Said memories can be recalled by concentration on the activity and reassociate the memory to the physical activity when needed.

DETAILED DESCRIPTION OF INVENTION

Figure 1:
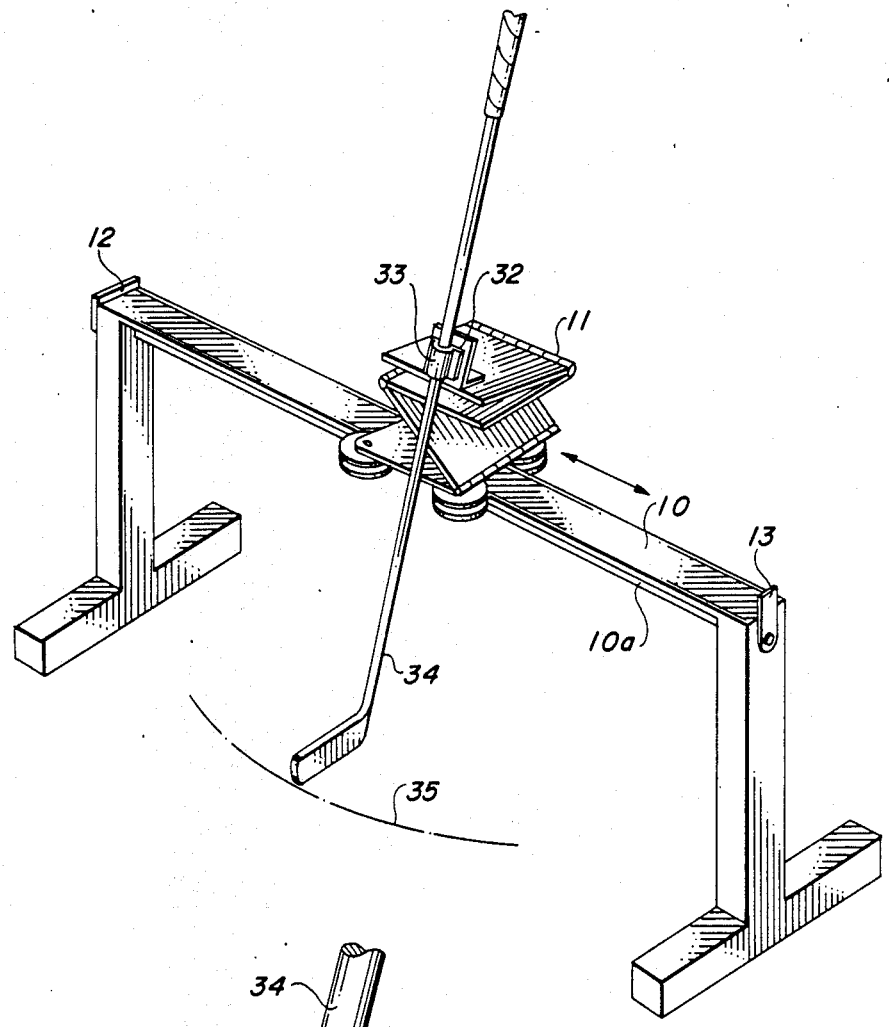
FIG. 1 is a perspective view of the invention.

The "Golf Putting Training Aid", the invention as shown in the drawings in FIG. 1. This machine is complete as drawn with T Bar guide rail 10 mounted on legs and footings has trolley 11 mounted and cinched to guide rail 10 that allows the trolley to only move back and forth laterally with a permanent stop 12 shown on the drawing and moveable stop 13 as shown. Moveable stop 13 allows for assembling of trolley to rail and in stop position prevents trolley from coming off rail 10.

Figure 2:
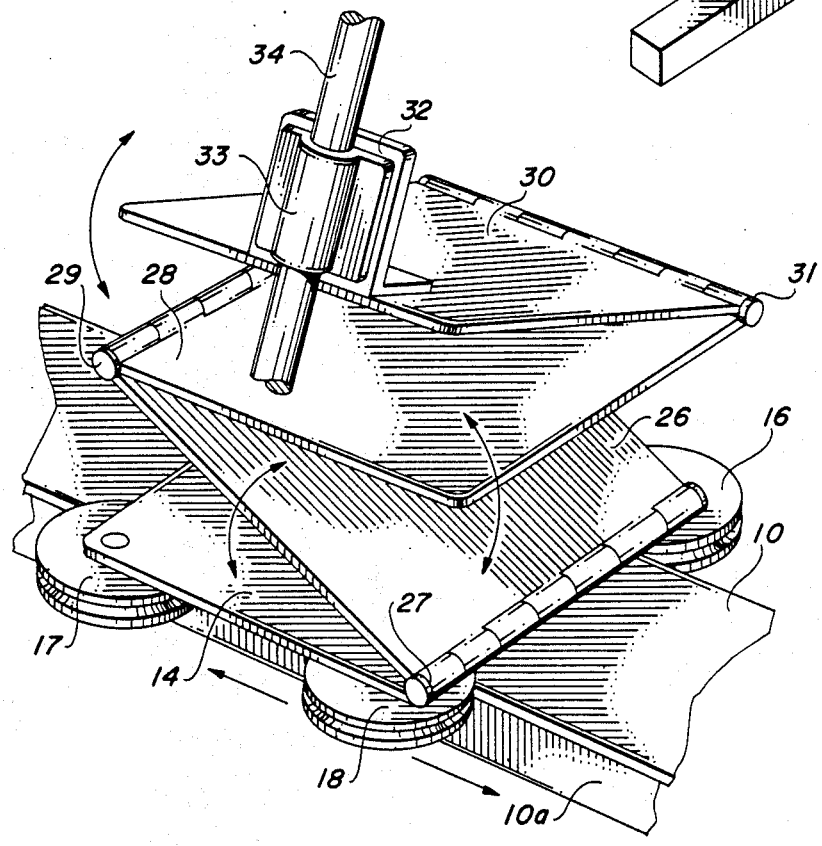
FIG. 2 is an enlarged perspective view of the trolley used in the invention.

On the drawing FIG. 2 shows hinge plate 26 attached to trolley hinge plate 14 by hinge pin 27 and hinge plate 28 attached to hinge plate 26 by hinge pin 29 and hinge plate 30 attached to hinge plate 28 by hinge pin 31. Hinge plate 30 is located at midpoint on back leading edge of 30 allowing plate 30 to raise at right angles to 28 and 26. Hinge plate 30 in FIG. 2 shows that club support 32 and shaft clamp 33 in FIG. 2 is attached to hinge plate 30 and shows attached club 34 in FIG. 1.

Figure 3:
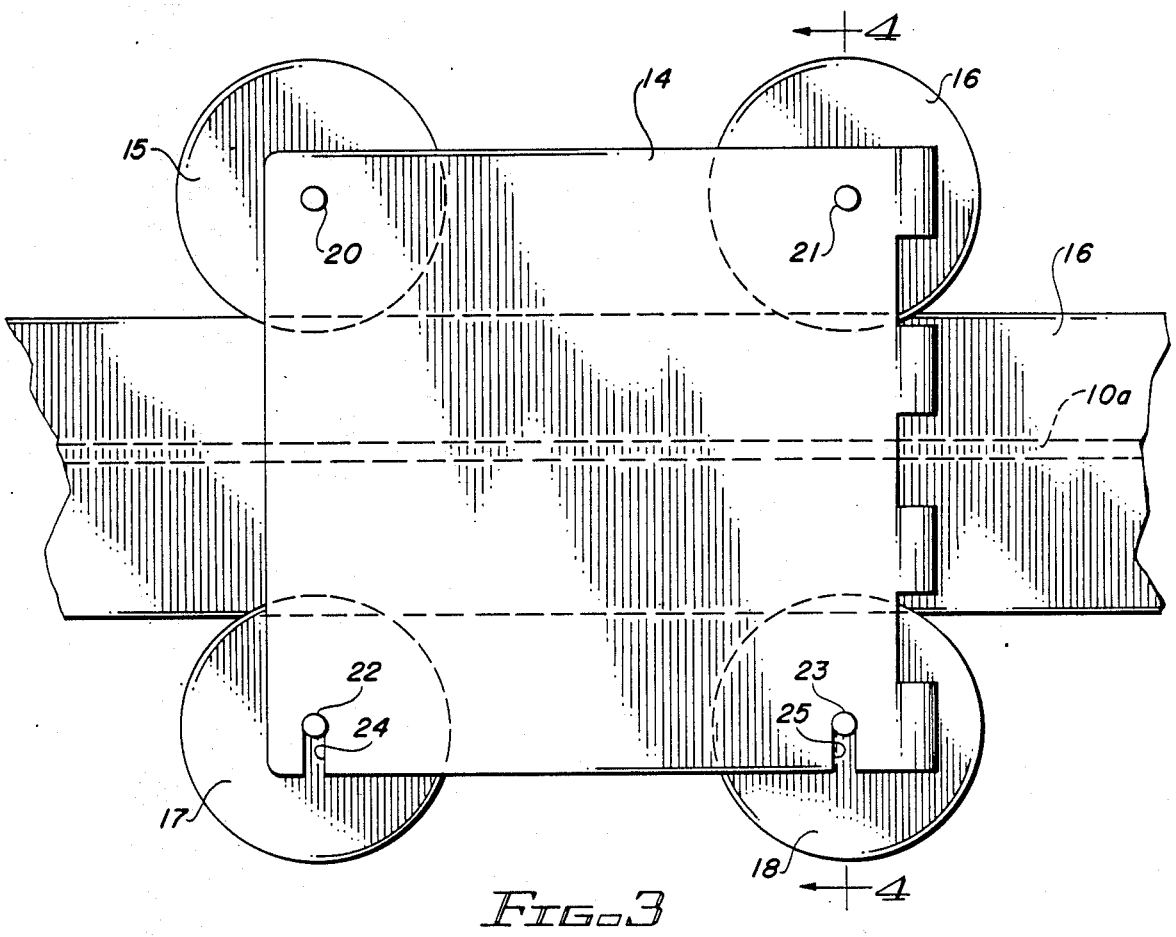
FIG. 3 is a top view showing the wheels of the trolley engaging the guide rail.
Figure 4:
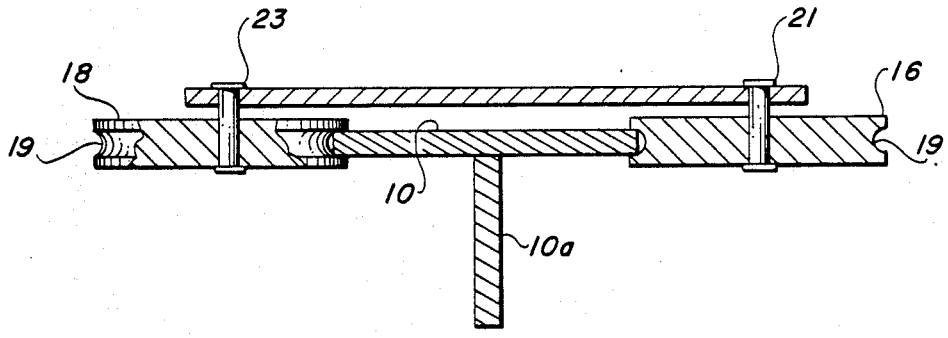
FIG. 4 is an end view of the guide rail showing the wheels of the trolley engaged with the guide rail.

In FIG. 3 there is a hinge plate 14 with wheels 15, 16, 17, 18 attached. Wheels have vee grove as shown in FIG. 4. Wheels 15 and 16 have permanent axles 20 and 21. Wheels 17 and 18 have axles 22 and 23 located in slots 24 and 25 for adjustment purpose to cinch wheels to rail 10 and make the combination of wheels 15, 16, 17, 18 and trolley plate 11 captive to the rail 10 allowing for only back and forth lateral movement.

Completely assembled and ready to be used the machine is made up of 16 separate parts including the golf putter club, as shown in FIG. 1 of the drawings, guide rail 10 mounted on legs and footings guides, and trolley 11 to roll on wheels 15, 16, 17, 18 laterally back and forth on the rail 10. Hinge plates 30, 26, 28 are connected together by hinge pins 27, 29, 31 which allow a rocking action and a lifting action by the hinge plates, which in turn makes an arc 35 of the club face which when the club grip is held as a pivot will allow the blade of the putter club to stroke the ball in a straight line to a target.

With all of the assembled parts as shown the golf putter club when put in motion will make the trolley move back and forth on rail 10 and the hinge plates and pins reacting to this motion will allow the blade of the golf club putter to form an arc FIG. 35. The shaft grip of the club is held by the person as a pendlum, the stroke will produce a straight line hit on the ball real or imaginary because the golf putter club is a captive to the trolley and the trolley is captive to the rail.

SUMMARY OF THE INVENTION

A machine that comprises a controlled trolley on a track that allows for only a straight line stroke to hit the golf ball. However, it is the design of the trolley and the fact that a golf putter is firmly attached to the trolley that is one of the novel aspects of this invention.

The design of the hinges and wheels that make up the trolley and the rail it rides on allows for a natural stroke to be produced when the trolley is put in motion by the person training on the machine.

This machine is used in any location as it needs no outside source of power nor does it have any power source built into it. The user may hit actual golf balls with it or stroke and follow through with no golf balls. It is not used in the game of golf.

I claim:

1. A golf putting training aid comprising:

a. a guide rail b. a trolley which comprises four vee-grooved wheels attached to a trolley hinge plate cinched on said guide rail, allowing for only back and forth lateral movement on said guide rail c. three additional hinge plates of similar size fastened to said trolley hinge plate with hinge pins i. the first of said additional hinge plates being attached to said trolley hinge plate by a hinge pin at the right lateral side ii. the second of said additional hinge plates being attached by a hinge pin to said first additional plate at the left lateral side iii. the third of said additional hinge plates being attached by a hinge pin to said second additional plate at the back edge of said second additional plate, allowing said third plate to raise relative the other plates, and d. a club support and clamp for holding a golf putter shaft firmly fastened to said third additional hinge plate at the front edge thereof midway between the ends of the hinge plates, allowing for stroking the club back and forth laterally.

* * * * *